US010627843B2

(12) United States Patent
Tourret

(10) Patent No.: US 10,627,843 B2
(45) Date of Patent: Apr. 21, 2020

(54) VOLTAGE REGULATOR CIRCUIT AND METHOD THEREFOR

(71) Applicant: NXP B.V., Eindhoven (NL)

(72) Inventor: Jean-Robert Tourret, Cormelles le Royal (FR)

(73) Assignee: NXP B.V., San Jose, CA (US)

( * ) Notice: Subject to any disclaimer, the term of this patent is extended or adjusted under 35 U.S.C. 154(b) by 0 days.

(21) Appl. No.: 16/040,623

(22) Filed: Jul. 20, 2018

(65) Prior Publication Data

US 2019/0079551 A1 Mar. 14, 2019

(30) Foreign Application Priority Data

Sep. 12, 2017 (EP) ..... 17306176

(51) Int. Cl.
*G05F 1/575* (2006.01)
*G05F 1/571* (2006.01)

(52) U.S. Cl.
CPC ..... *G05F 1/575* (2013.01); *G05F 1/571* (2013.01)

(58) Field of Classification Search
CPC ..... G05F 1/575; G05F 1/571
See application file for complete search history.

(56) References Cited

U.S. PATENT DOCUMENTS

2007/0053115 A1 3/2007 Tain et al.
2010/0213913 A1 8/2010 Shito
2012/0176107 A1 7/2012 Shrivas et al.
2014/0159683 A1 6/2014 Pan et al.
2014/0285165 A1 9/2014 Wang et al.
2014/0354249 A1* 12/2014 Kurozo ..... G05F 1/575 323/271
2014/0355161 A1 12/2014 Torres et al.

OTHER PUBLICATIONS

Zheng et al., Oct. 2011, IEEE, Trans. Circuits and System vol. 58 No. 10, pp. 2377-2387.*
Ou et al, "Ultralow-power fast-transient output-capacitor-less low-dropout regulator with advanced adaptive biasing circuit," IET Circuits, Devices & Systems, 2015, vol. 9, Issue 3, pp. 172-180.
(Continued)

*Primary Examiner* — Jue Zhang

(57) ABSTRACT

A low drop out, LDO, voltage regulator circuit is that includes a high gain amplifier configured to receive a current biasing signal and arranged to regulate the voltage supply signal and output a regulated voltage supply signal. A regulation adjustment circuit is operably coupled to an output of the high gain amplifier and includes a comparator configured to compare the output regulated voltage supply signal with a threshold, wherein an output of the comparator is configured to perform one of: (i) supply a dynamic current boost to the LDO current biasing signal, in response to the regulated voltage supply signal voltage dropping below the threshold; (ii) activate a dynamic current pull down circuit to reduce an over voltage output of the LDO voltage regulator circuit in response to the regulated voltage supply signal voltage exceeding the threshold.

20 Claims, 4 Drawing Sheets

(56) References Cited

OTHER PUBLICATIONS

Or et al, "An Output-Capacitorless Low-Dropout Regulator With Direct Voltage-Spike Detection," IEEE Journal of Solid-State Circuits, vol. 45, No. 2, Feb. 2010, pp. 458-466.
Lam et al., "Adaptively-Biased Capacitor-Less CMOS Low Dropout Regulator with Direct Current Feedback," IEEE, 2006, pp. 104-105.
Lee et al., "Low-Flicker-Noise and High-Gain Mixer Using a Dynamic Current-Bleeding Technique", IEEE Microwave and Wireless Components Letters, Aug. 1, 2017, vol. 27, No. 8, pp. 733-735.

* cited by examiner

VOLTAGE REGULATOR CIRCUIT AND METHOD THEREFOR

CROSS-REFERENCE TO RELATED APPLICATIONS

This application claims priority under 35 U.S.C. § 119 to European patent application no. EP 17306176.3, filed Sep. 12, 2017, the contents of which are incorporated by reference herein.

FIELD OF THE INVENTION

The field of this invention relates to a voltage regulator circuit and method therefor. In particular, in some examples, the field of this invention relates to an ultra-low power complementary metal oxide semiconductor (CMOS) low drop-out (LDO) voltage regulator circuit with a fast transient response.

BACKGROUND OF THE INVENTION

Power supply circuits within modern integrated circuit (IC) devices are often required to generate a constant, stable output voltage, typically from a varying input voltage. For example, in automotive applications a power supply circuit may be required to generate a regulated 7V output voltage from an input voltage from a battery comprising a voltage level ranging from, say, a nominal battery voltage of 14V down to 2.5V. Thus, low drop out voltage regulator circuits that provide a regulated supply voltage to circuits and functions have become popular.

With respect to LDO voltage regulator circuits, GO2 is an NMOS or PMOS device of the process, with significantly thicker gate oxide. These devices can therefore withstand high voltages, with ultra-low leakage. It is generally a large device, and the digital cells using it can be up to ten times larger than the standard cells (i.e., using GO1 devices that use regular gate thickness).

Voltage regulator circuits are now often used in 'Internet of Things' (IoT) devices. Voltage regulator circuits are also often used in 'connected devices', which is a term that is used to describe a device connected to a network via a radio frequency (RF) communication protocol, like ZigBee™, Bluetooth™, or any other radio protocol. A connected device is generally powered by a battery, which has a limited life time, depending on the current consumption of the said connected device. As a result, the lower the current consumption, the longer the device life time, and this has led to use of LDO supply voltages.

These connected devices spend most of their time waiting for an event that is triggered externally (e.g: a temperature sensor sending out its data, say, once a day, to a network, or a connected switch that sends out its data to a connected bulb, say, once in a while, or a home alarm system with a remote control that sends out its data to the alarm centre). These are some of the IoT use cases, mostly requiring a 'nearly-always-off' state, which is often referred to as a Deep Power Down (DPD) mode.

As a consequence, the current consumption whilst in DPD mode mostly determines the battery lifetime. Hence, it is necessary to minimize the current consumption of the circuits and functional blocks that still need to ensure some state retention in this mode, typically referred to as 'always-on' circuits and functional blocks.

Dependent upon the process node, it is not always possible to benefit from very low leakage digital libraries (generally using GO2 devices), and as a result GO1-based digital cells have to be used. When supplied with their nominal voltage (e.g. 1.1V in a 40 nm process), they are known to 'leak' current much more than the IoT standard allows. This is especially the case when the digital design represents a relatively large number of cells, e.g. large enough to impact the total current consumption due to the cells' leakage. A way to drastically reduce this leakage is to decrease the supply voltage down to a minimum value, under which retention may become erratic.

The only way to control properly the supply voltage to these always-on digital cells is to use an 'always-on' LDO, which itself has to consume a very small part of the current budget. Though weakly biased, such LDOs have to firmly maintain their regulated output close to a regulation target in order not to endanger the circuits and functional blocks that they supply, irrespective of the load current transitions.

FIG. 1 illustrates a conventional LDO output response 100 to an increase in different load current from line 145 to line 140. The LDO output response 100 illustrates target output voltage 110 and current load (Iload) 115 versus time 120. It is known by those skilled in the art that the reaction time Δt of an LDO is inversely proportional to its regulation bandwidth. When the biasing current is very low, then the reaction time is very high. As a consequence, any abrupt increase of the load current (e.g. from 145 to 140) will make the output voltage drop (from 130 to 135) until the feedback loop in the voltage regulator counteracts it and returns the LDO voltage back to the target voltage 125, as illustrated in FIG. 1.

The equation that basically provides the voltage drop ΔV at the output of a conventional LDO is the following:

$$I\text{load}*\Delta t = C\text{load}*\Delta V, \quad [1]$$

With:

Iload identifying the average load current;

Δt identifying the reaction time of the LDO; and

Cload identifying the decoupling capacitor value of the LDO.

When using biasing currents that are too small, the bandwidth of the LDO becomes so small that Δt becomes very high. Thus, any sudden Iload increase turns into an uncompensated drop at the LDO output, at least temporarily. In addition, a digital design does not demand a constant current to its supply, and as such there can be sudden current peaks linked to the digital activity. It can easily be figured out by a person skilled in the art that the output of a conventional weakly biased LDO will not be regulated well with this type of varying load current. An improved voltage regulator circuit and a method of regulating a voltage in response to rapid changes of load current are required.

In the publication titled '*Ultralow-power fast-transient output-capacitor-less low-dropout regulator with advanced adaptive biasing circuit*', authored by Xi Qu et al, and published in *IET Circuits, Devices & Systems,* 2015, the authors' proposed design focused on the ability to react quickly to a current decrease. In essence, the authors propose to use the output current information, not the regulated output itself. This publication does not consider any effect of, or propose any solution to, a fast current increase. The inventor of the present invention has recognised and appreciated that this publication also does not consider true zero load current to high load current transients.

In the publication titled '*An Output-Capacitor-less Low-Dropout Regulator With Direct Voltage-Spike Detection*', authored by Pui Ying Or and Ka Nang Leung, and published in *IEEE JOURNAL OF SOLID STATE CIRCUITS*, VOL. 45, NO. 2, FEBRUARY 2010, the authors' proposed design includes a dynamic compensation of the LDO when voltage spikes occur at the LDO output. Notably, this design is tightly linked to a specific LDO topology (i.e. a PMOS output stage). The dynamic compensation of the design specifically, and solely, occurs for a fixed time after the spike event and has quiescent currents in the range of tens of μA.

In the publication titled '*Adaptively-Biased Capacitor-Less CMOS Low Dropout Regulator with Direct Current Feedback*', authored by Yat-Hei Lam et al, and published in IEEE, 2006, the authors' proposed design is of a linear output load current adaptive biasing scheme. Notably, it is unsuitable for an ultra-low power design, as a lot of current hungry circuitry is needed, and, not least that the design requires ~3 μA @ zero load current.

SUMMARY OF THE INVENTION

The present invention provides a LDO voltage regulator circuit and a method of regulating a LDO voltage supply signal as described in the accompanying claims. Specific embodiments of the invention are set forth in the dependent claims. These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the figures are illustrated for simplicity and clarity and have not necessarily been drawn to scale.

DETAILED DESCRIPTION

Figure 1:
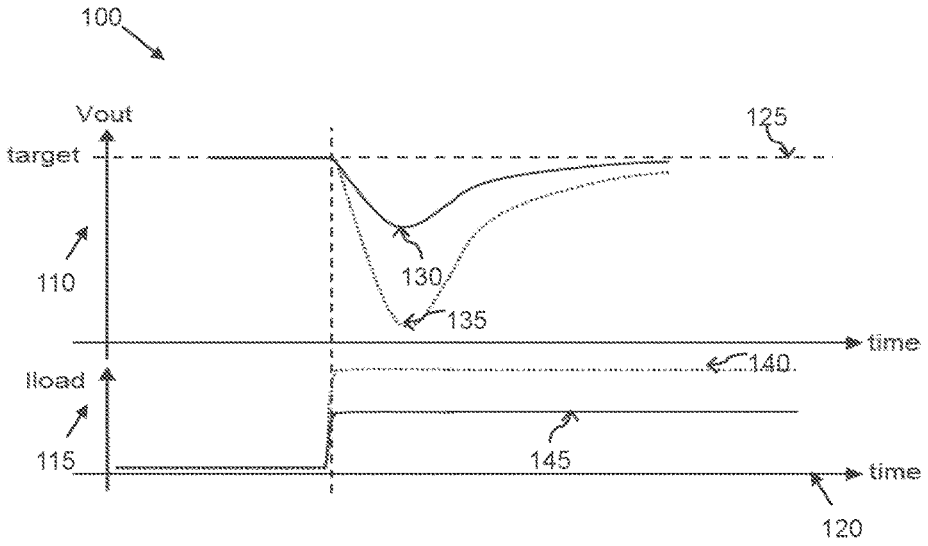
FIG. 1 (PRIOR ART)
FIG. 1 illustrates a conventional LDO output response to a rapid increase in load current.

The present invention will now be described with reference to an LDO topology suitable for use in an ultra-low power CMOS LDO with fast transient response, for example for use with IoT circuits. Examples of the invention propose a use of a regulation adjustment circuit operably coupled to an output of the high gain amplifier of the LDO and configured to dynamically react to any transition of the regulated output outside of a desired regulated voltage range. The regulation adjustment circuit functions as one or more additional feedback loops that reside outside of the main feedback loop of the LDO. Some examples of the invention propose a watchdog loop as the regulation adjustment circuit, configured to detect when the output voltage goes too low, and in response thereto boosts the LDO biasing until the voltage has gone sufficiently high. Advantageously, a watchdog loop that is located outside of the main feedback loop is able to compensate for a very slow response of an LDO due to very small biasing currents.

Some examples of the invention propose an over-voltage protection loop as the regulation adjustment circuit, configured to detect when the output voltage goes too high, and in response thereto activates a current pull down circuit until the regulated voltage has returned to a desired level or range. Advantageously, an over-voltage protection loop that is located outside of the main feedback loop is also able to compensate for a very slow response of an LDO due to very small biasing currents. In essence, a watchdog loop and/or over-voltage protection loop (so constructed outside of the main feedback loop) does not therefore interfere with the main feedback loop, and hence does not impact its stability parameters.

Additionally, examples of the invention also feature circuitry that prevents the output voltage increasing above the technology limits. As such, examples of the invention find particular use with advanced low-power CMOS circuits, currently of the order of 40 nm.

Examples of the invention describe a low drop out, LDO, voltage regulator circuit arranged to receive a voltage supply signal, and to output a regulated voltage signal. The voltage regulator circuit includes: a high gain amplifier, such as an OTA, configured to receive a current biasing signal and arranged to regulate the voltage supply signal and output a regulated voltage supply signal. A regulation adjustment circuit is operably coupled to an output of the high gain amplifier and includes a comparator configured to compare the output regulated voltage supply signal with a threshold, wherein an output of the comparator is configured to perform one of:

(i) supply a dynamic current boost to the LDO current biasing signal, in response to the regulated voltage supply signal voltage dropping below the threshold;

(ii) activate a dynamic current pull down circuit to reduce an over voltage output of the LDO voltage regulator circuit in response to the regulated voltage supply signal voltage exceeding the threshold.

In some examples, the regulation adjustment circuit may include a watchdog loop circuit operably coupled to an output of the high gain amplifier and comprising a watchdog comparator configured to compare the output regulated voltage supply signal with a watchdog threshold reference voltage (wd_ref) and in response to the regulated voltage supply signal voltage dropping below the watchdog threshold reference voltage (wd_ref) an output of the watchdog comparator supplies a dynamic current boost to the LDO current biasing signal.

In some examples the regulation adjustment circuit may include an over voltage protection, OVP, loop circuit operably coupled to an output of the high gain amplifier and wherein the comparator includes an OVP comparator configured to compare the regulated voltage supply signal with an OVP threshold reference voltage (ovp_ref) and in response to the regulated voltage supply signal voltage exceeding the OVP threshold reference voltage (ovp_ref) the output of the OVP comparator activates the dynamic current pull down circuit to reduce an over voltage output of the LDO voltage regulator circuit.

Furthermore, because the illustrated embodiments of the present invention may for the most part, be implemented using electronic components and circuits known to those skilled in the art, details will not be explained in any greater extent than that considered necessary as illustrated below, for the understanding and appreciation of the underlying concepts of the present invention and in order not to obfuscate or distract from the teachings of the present invention.

Figure 2:
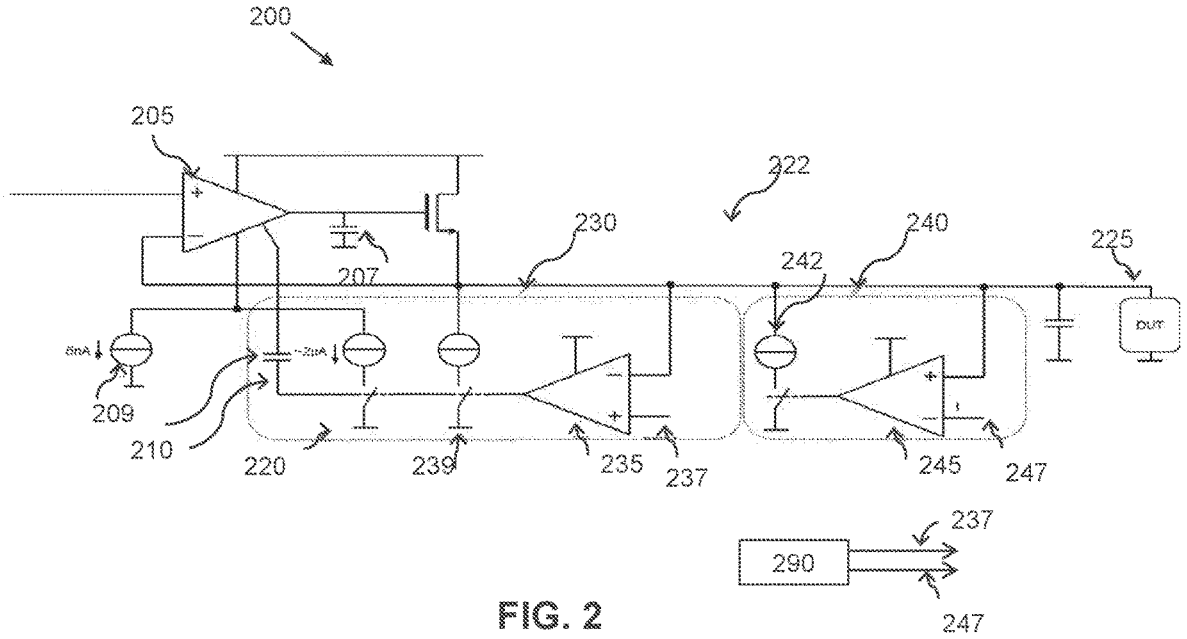
FIG. 2 illustrates a first example of a LDO topology, according to examples of the invention.

Referring now to FIG. 2, a first example of a LDO topology 200 is illustrated, according to examples of the invention. The illustrated LDO topology 200 is applicable to a wide range of circuit voltages and currents, from nA through μA or even mA values. However, for higher current applications of μA or even mA values, the benefits of using an additional control loop, such as a watchdog loop and/or an OVP loop, outside of the main feedback loop, reduces. In such higher current applications the biasing currents in themselves are large enough to ensure a large LDO bandwidth, in order to respond to fast transients of the load current. Here, the fast transient responses can be addressed in an analog/digital integrated circuit (IC) with moderate integrated capacitive decoupling (say of the order of <10 nF). Hence, it is envisaged that the LDO examples of the invention are most compatible with ultra-low power consumption applications, where fast transients for a relatively slow LDO are particularly problematic. The category of ultra-low power designs typically range from a few nA to a few tens of nA of biasing current, where the quiescent currents of each branch may be of the same order of magnitude than the leakages of the used devices. Such ultra-low power design requires very specific sizing of each transistor, careful bulk connections, etc.

The LDO topology 200 of FIG. 2 includes a very high gain amplifier 205, which in some examples may be an Operational Transconductance Amplifier (OTA). Some known LDO circuits use an OTA as a very high gain amplifier to achieve low residual static errors during regulation, by applying a fixed biasing. The fixed biasing is achieved using an OTA switched boost biasing current 220 and a switched bleeding current 225. Although the OTA of known LDO circuits has a high gain, it is unable to deliver any current to a load without affecting drastically its characteristics (static error, gain, etc.). As a consequence, an output stage 215 (or power stage) is needed to interface with the external circuitry and provide current to a load (not shown).

The minimum quiescent current needed by the high gain amplifier 205 is delivered by a fixed current source 209. When the regulated output voltage is above the watchdog threshold reference voltage (wd_ref) 237, this quiescent current is sufficient to guarantee a stable regulation scheme with a slow response. When the LDO 200 becomes overloaded, due to the load current decreasing, the watchdog loop 230 is turned on, and a large additional (boost) biasing current is delivered by the current source 220 to the high gain amplifier 205.

Examples of the invention include a watchdog loop 230 comprising a watchdog loop comparator 235 that compares the output voltage with a reference voltage 237 in order to provide dynamic compensation. In examples of the invention, the watchdog loop 230 is configured to detect when the output voltage goes too low, and, in response thereto, the watchdog loop comparator 235 generates a dynamic boost current 212 that is arranged to boost the LDO bias until the regulated output voltage has gone sufficiently high.

Thus, in accordance with examples of the invention, an adaptive biasing scheme is employed using the watchdog loop 230. In some examples, and notably, the activation of the watchdog loop 230 is only triggered during a period where the voltage falls below a watchdog threshold, which may be set by reference voltage 237.

The above approach to dynamic voltage regulation is different to conventional LDO voltage regulation that uses adaptive biasing to convert the regulation scheme to a current change, primarily used to keep the LDO stable, irrespective of the load. A conventional LDO voltage regulation does not ensure that the loop will react quickly if the output current suddenly grows. Furthermore, when the load current suddenly decreases, a conventional LDO (i.e. weakly biased without the proposed additional circuitry in examples of the invention) will increase Vout up to an uncontrolled value, which can be as high as Vbat, thus damaging the circuitry supplied by Vout.

In contrast, examples of the present invention propose dynamically adapting the biasing to the load demand, but notably outside of the main feedback loop, which ensures that the output voltage control. Furthermore, the adaptive biasing of the regulation scheme is effected in the voltage domain. In this manner, and advantageously, the watchdog loop 230 can be very weakly biased because, in the illustrated example, the watchdog loop 230 includes an open loop comparator 235, and is not, in essence, located in an analog feedback loop.

Additionally, in some examples of the invention, an over voltage protection (OVP) loop 240 is also included to provide overvoltage protection. The OVP loop 240 includes an OVP loop comparator 245 that compares the output current with a reference current 247 in order to provide dynamic compensation to any change in bias voltage and dynamically adapts the biasing to the load demand, outside of the main feedback loop.

In some examples, the LDO voltage regulator circuit may include a programmable controller 290, for example configurable to generate and dynamically adjust, one or more threshold values, such as at least one of: the watchdog threshold reference voltage (wd_ref) 237, and the OVP threshold reference voltage (ovp_ref) 247. In this manner, the LDO voltage regulator circuit benefits from being fully programmable, for example by the programmable controller 290 using a fine adjustment of one or more of these threshold voltage(s).

The comparators 235, 245 may be implemented using, for example, any kind of comparator that has a reference input and a time response that is compatible with the needs of the circuit and application used. Although examples of the invention are described with reference to using one or more comparators 235, 245 to determine when a threshold is exceeded (or a measured voltage drops below the threshold), it is envisaged that in other examples the one or more comparators 235, 245 may not necessarily need a reference input 237, 247, e.g. a simple CMOS inverter may alternatively be employed. However, in this simpler circuit configuration, a skilled artisan will appreciate that this is a less flexible design as it is not possible to change the comparison threshold. Additionally, it is envisaged that any kind of switched biasing scheme, for example for the switched boost biasing and/or switched boost bleeding, may be used in accordance with the design style or requirements of the LDO.

Figure 3:
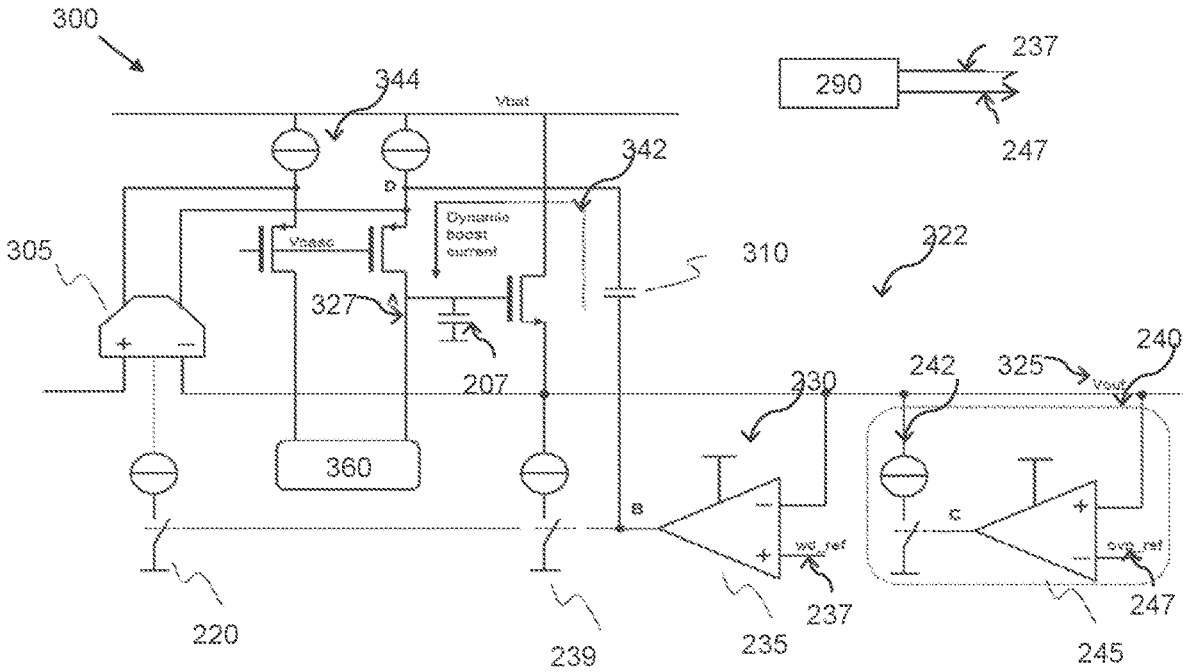
FIG. 3 illustrates a second example of a LDO topology, according to examples of the invention.

Referring now to FIG. 3, a second example of a LDO topology 300 is illustrated, according to examples of the invention. In this example, the LDO topology 300 includes an Operational Transconductance Amplifier (OTA) 305, which is a very high gain amplifier used in feedback loops to achieve low residual static errors in regulation. A fixed biasing may be achieved using an OTA switched boost biasing current 220 and a switched bleeding current 325.

Examples of the invention include a watchdog loop 230 comprising a watchdog loop comparator 235 that compares the output voltage with a reference voltage 237 in order to provide dynamic compensation. In examples of the invention, the watchdog loop 230 is configured to detect when the output voltage goes too low, and in response thereto boosts the LDO biasing until the voltage has gone sufficiently high. Thus, in accordance with examples of the invention, an adaptive biasing scheme is employed using the watchdog loop 230. In some examples, and notably, the activation of the watchdog loop 230 is only triggered during a period where the voltage falls below a watchdog threshold, which may be set by reference voltage 237.

The above approach to dynamic voltage regulation is different to conventional LDO voltage regulation that uses adaptive biasing to convert the regulation scheme to a current change, primarily used to keep the LDO stable, irrespective of the load. A conventional LDO voltage regulation does not ensure that the loop will react quickly if the output current suddenly grows. Furthermore, when the load current suddenly decreases, a conventional LDO (i.e. weakly biased without the proposed additional circuitry in examples of the invention) will increase Vout up to an uncontrolled value, which can be as high as Vbat, thus damaging the circuitry supplied by Vout.

In contrast, examples of the present invention propose dynamically adapting the biasing to the load demand, but notably outside of the main feedback loop, which ensures a fast response. Furthermore, the adaptive biasing of the regulation scheme is effected in the voltage domain. In this manner, and advantageously, the watchdog loop 130 can be very weakly biased because, in the illustrated example, the watchdog loop 130 includes an open loop comparator 235, and is not, in essence, located in an analog feedback loop.

Although examples of the invention are described with reference to the circuit configuration of FIG. 2 or FIG. 3, it is envisaged that the way the dynamic compensation acts on the OTA internal biasing may be dependent on the respective OTA topology, and thus may differ from one OTA topology to one another. Irrespective of the circuit implementation details, the dynamic compensation concepts proposed herein will always target a quick voltage increase (or decrease) of the regulated output. Although the described topology is a folded-cascode OTA architecture, it is envisaged that, in other examples, a simple active load could react equally as well, if used with cascode current sources. Furthermore, it is envisaged that in other examples the OTA 305 may also be a n-stage OTA, should the loop gain be needed to be larger. The second example of a LDO topology 300 includes a current mirror circuit 360 that is configured to convert the differential input voltage of the OTA 305 to a single ended output voltage on node A 327. In this implementation, the current mirror circuit 360 is shown as using N-type transistors. However, in other examples, it is envisaged that the current mirror circuit 360 may be implemented using P-type transistors if all the transistors types of the described implementation were inverted.

The LDO includes a decoupling capacitor 207. In some examples, a compensation capacitor 210 anchor point may be employed. In such examples, the compensation capacitor (CapComp) 210 may be needed to perform a dynamic compensation. Thus, in some examples, a compensation current 342 instantaneously flows in the cascode transistor circuit 344, which is equal to:

$$I\text{compensation}(342)=\text{CapComp}*V\text{out}/\Delta t \quad [2]$$

In this manner, the compensation current 342 is fixed for a given process. The rate of the current increase at the main pole node 'A' 327 is then fixed by the design and avoids any over compensation, which could lead to undesired behaviours.

Additionally, in some examples of the invention, an over voltage protection (OVP) loop 240 is also included to provide overvoltage protection. The OVP loop 240 includes an OVP loop comparator 245 that compares the output current with a reference current 247 in order to provide dynamic compensation to any change in bias voltage and dynamically adapts the biasing to the load demand, outside of the main feedback loop.

Additionally, it is envisaged that any kind of switched biasing scheme, for example for the switched boost biasing and/or switched boost bleeding, may be used in accordance with the design style or requirements of the LDO.

Figure 4:
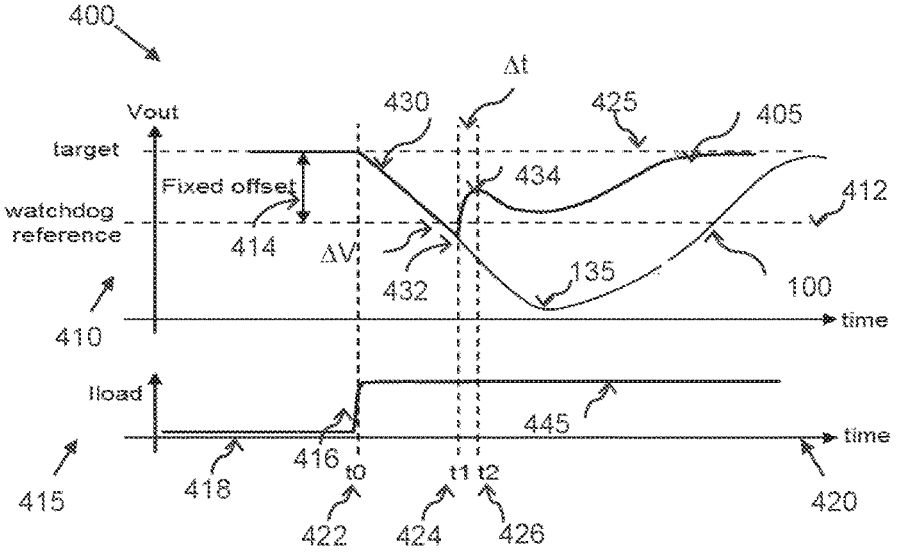
FIG. 4 illustrates a graphical behavioural example of the LDO output voltage of the LDO circuit of FIG. 2 or FIG. 3, in response to a load current increase, according to examples of the invention.

Referring now to FIG. 4, a graphical behavioural example 400 of the LDO output voltage of the LDO circuit of FIG. 2 or FIG. 3 is illustrated, in response to a load current increase 416, according to examples of the invention. The example graphical behaviour 400 includes a typical graphical response 100 of a known LDO circuit, as illustrated in FIG. 1.

The example graphical behaviour 400 illustrates both the LDO output voltage 410 versus time 420, as well as the load current (Iload) 415 versus time. In this illustrated example initially the LDO output voltage (Vout) 410 is on target output voltage 425, with the LDO regulating to a small Iload 418. At a time t0 422, the load current (Iload) 415 increases suddenly 416, as some additional current is required at the LDO output to a higher load current 445. In response thereto, the LDO output voltage (Vout) 410 begins to decrease 430. Subsequently, at a time t1 424, the LDO output voltage (Vout) 410 has traversed below a watchdog reference threshold voltage (wd_ref) 412. At this point, the watchdog comparator triggers and the dynamic compensation provided by the watchdog loop, such as watchdog loop 230 of FIG. 2. Thus, the LDO enters a boost mode of operation at 432. In response to the dynamic activation of the boost mode, the LDO output voltage (Vout) 410 increases quickly. The output stage gate biasing is also quickly increased such that when the boost mode is stopped, the drop rate will be slower. It takes a time Δt to perform due to the switching time of any associated buffer circuit or component.

At a time t2 426, the LDO output voltage (Vout) 410 has traversed above 434 the watchdog reference threshold voltage (wd_ref) 412, and the boost mode is stopped. Thereafter, the LDO voltage returns more quickly to its normal regulation mode of operation with a regulation target 405.

In this example, thanks to the dynamic compensation provided by the watchdog loop identifying when a threshold voltage is traversed and triggering a boost mode of operation in response thereto, the internal LDO biasing is able to withstand load current variations. Here, an automatic boost mode is entered, when needed in order to boost the LDO voltage up to the regulation target 405. Advantageously, this boost mode mechanism is repeated each time that the load current (Iload) 415 change is faster than the LDO response time. Furthermore, and advantageously, this boost mode mechanism ensures that the LDO output voltage (Vout) 410 will quickly return within the range of the watchdog reference threshold voltage (wd_ref) 412 and the target output voltage 425.

Figure 5:
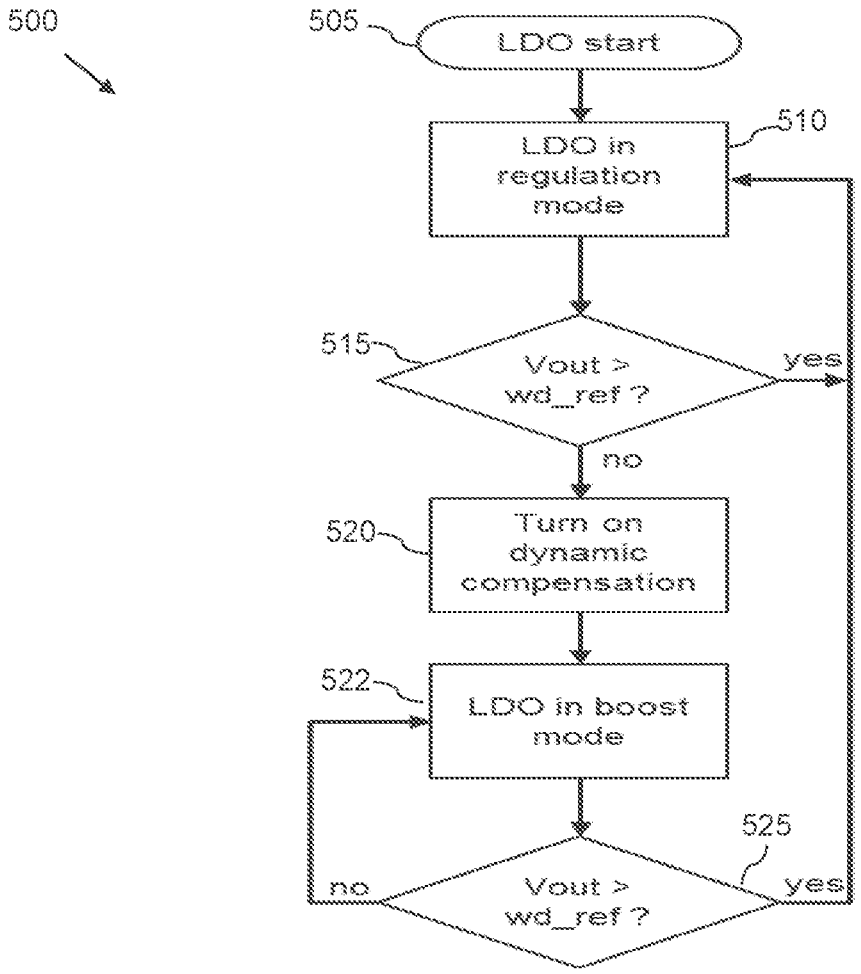
FIG. 5 illustrates a first flowchart of a first dynamic mechanism to prevent the LDO output voltage (Vout) transitioning beyond a too high output voltage, for instance when the load current suddenly decreases, according to examples of the invention.

Referring now to FIG. 5, a simplified example flowchart 500 of a first dynamic mechanism to prevent the LDO output voltage (Vout) transitioning beyond a too-low output voltage, for instance when the load current suddenly increases, is illustrated according to examples of the invention. The method starts at 505 with the LDO being activated, and moves on to 510, where the LDO is placed in a normal voltage regulation operating mode. At 515, a determination is made as to whether the LDO output voltage (Vout), such as the LDO output voltage (Vout) 310 in FIG. 3, has traversed below a watchdog reference threshold voltage (wd_ref 312). If it is determined that the LDO output voltage (Vout) is above, and not below, the watchdog reference threshold voltage (wd_ref) in 515, the flowchart loops to 510 with the LDO being in a normal voltage regulation operating mode. However, if it is determined that the LDO output voltage (Vout) is below the watchdog reference threshold voltage (wd_ref) in 515, the flowchart moves to 520 and the current boost functionality of the watchdog loop is activated. Thereafter, the LDO is operated in a boost mode at 522 with a determination at 525 as to whether the LDO output voltage (Vout) has traversed again above the watchdog reference threshold voltage (wd_ref). If the LDO output voltage (Vout) has not yet traversed above the watchdog reference threshold voltage (wd_ref), the flowchart loops to 522 and remains in current boost mode. If the LDO output voltage (Vout) has traversed above the watchdog reference threshold voltage (wd_ref), then the flowchart loops to 510. At 510, the LDO is placed again in a normal voltage regulation operating mode, but with the LDO output voltage residing between the target output voltage and the watchdog reference threshold voltage.

Figure 6:
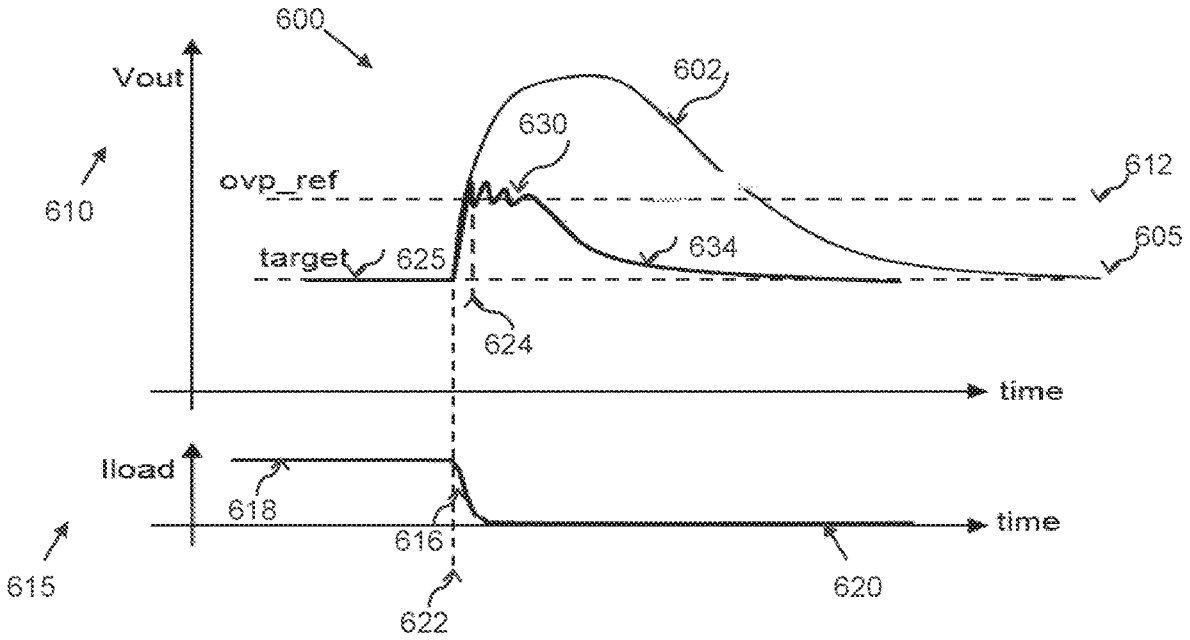
FIG. 6 illustrates a graphical behavioural example of a comparison of the over-voltage protection operation of the LDO circuit of FIG. 2 or FIG. 3, in response to a load current decrease, versus a conventional LDO over-voltage protection operation.

Referring now to FIG. 6, a graphical behavioural example 600 illustrates a comparison of the over-voltage protection operation 240, 340 of the LDO circuit of FIG. 2 or FIG. 3, in response to a load current decrease 616, versus a conventional LDO over-voltage protection operation. The example graphical behaviour 600 includes a typical graphical response 602 of known over-voltage conditions of an LDO circuit.

The example graphical behaviour 600 illustrates both the LDO output voltage 610 versus time 620, as well as the load current (Iload) 615 versus time 620. In this illustrated example initially the LDO regulated output voltage (Vout) 610 is on a target output voltage 625, in response to Iload 618. At a time t0 622, the load current (Iload) 615 decreases suddenly at 616. In response thereto, the LDO output voltage (Vout) 610 begins to rapidly increase. The use of an OVP circuit ensures that, at a time t1 624, the LDO output voltage (Vout) 610 has traversed above an OVP reference threshold voltage 612. At this point, the OVP protection circuit triggers and a dynamic compensation is provided by the OVP circuit loop, such as OVP circuit loop 240 of FIG. 2 or 340 of FIG. 3. Here, a dynamic current pull-down circuit is activated to reduce an over voltage output of the LDO voltage regulator circuit in response to the regulated voltage supply signal voltage exceeding a second threshold. Thereafter, the LDO voltage returns to its normal regulation mode of operation 605.

In this example, thanks to the dynamic compensation provided by the ovp loop identifying when a threshold voltage is traversed and triggering a dynamic current pull-down mode of operation, the internal LDO biasing is able to withstand load current variations, with an automatic dynamic current pull-down mode entered when needed to reduce the LDO voltage down to the regulation target. Furthermore, and advantageously, this boost mode mechanism ensures that LDO output voltage (Vout) 610 will substantially remain within the range of the ovp reference threshold voltage (ovp_ref) 612 and the target output voltage 625. An additional bleeding current on the LDO output stage, is switched on when the LDO regulated output voltage (Vout) is detected higher than the overvoltage protection reference voltage ovp_ref. Advantageously, in examples of the invention, control of the circuit can be fully programmable, in the same manner as for the watchdog loop of FIG. 2 and FIG. 3.

Thus, when a load current suddenly decreases in a weakly biased conventional LDO, the conventional LDO output voltage (Vout) will increase up to an uncontrolled value (e.g. 602), which can be as high as Vbat, thus damaging the circuitry supplied by Vout. In contrast, in accordance with examples of the invention, the LDO with over-voltage protection has the ability to clamp accurately Vout to the over voltage protection reference (ovp_ref) 612.

Figure 7:
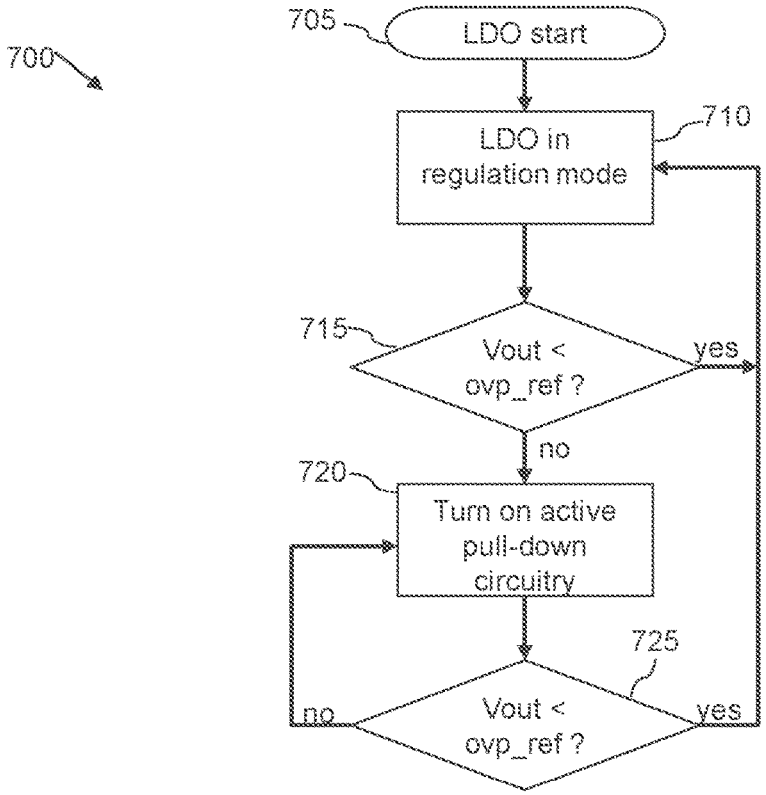
FIG. 7 illustrates a second flowchart of a second dynamic mechanism to prevent the LDO output voltage (Vout) transitioning beyond a too high output voltage, for instance when the load current suddenly decreases, according to examples of the invention.

FIG. 7 illustrates a second dynamic LDO flowchart for an over-voltage protection mechanism, namely to prevent the LDO regulated output voltage (Vout) going beyond a too-high output voltage, for instance when the load current suddenly decreases, according to examples of the invention. The method starts at 705 with the LDO being activated, and moves on to 710, where the LDO is placed in a normal voltage regulation operating mode. At 715, a determination is made as to whether the LDO output voltage (Vout), such as the LDO output voltage (Vout) 310 in FIG. 3, is below an over-voltage protection reference threshold voltage. If it is determined that the LDO output voltage (Vout) is below the over-voltage protection reference threshold voltage in 715, the flowchart loops to 710 with the LDO remaining in a normal voltage regulation operating mode. However, if it is determined that the LDO output voltage (Vout) is equal to or above the over-voltage protection reference threshold voltage in 715, the flowchart moves to 720 and a pull-down circuit of the over-voltage protection loop is activated. Thereafter, the LDO is operated in a reduce overshoot voltage mode with a determination at 725 as to whether the LDO output voltage (Vout) has traversed again above the watchdog reference threshold voltage (wd_ref). If the LDO output voltage (Vout) has not yet traversed below the over-voltage protection reference threshold voltage, the flowchart loops to 720. If the LDO output voltage (Vout) has traversed below the over-voltage protection reference threshold voltage, then the flowchart loops to 710. At 710, the LDO continues, or is placed again, in a normal voltage regulation operating mode, until the ovp reference threshold is exceeded again.

Thus, examples of the invention illustrated in FIG. 2 and FIG. 3 provide two examples of correcting an output voltage in a voltage regulation circuit when the regulator transitions outside of a desired level of performance. The illustrated out-of-the-regulation switched loops, enable a fast response to load transients, whilst advantageously keeping the main feedback loop weakly biased. Furthermore, in some examples, the biasing range may be configured to be compatible with ultra-low power applications, for example less than 20 nA for the whole design. In addition, the LDO voltage regulator circuit may be insensitive to an absolute value of the load current, in that any output current transients may range from a true zero load current (e.g. a few nA) to a high load current (e.g. a few mA).

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals. Although specific conductivity types or polarity of potentials have been described in the examples, it will be appreciated that conductivity types and polarities of potentials may be reversed.

Each signal described herein may be designed as positive or negative logic. In the case of a negative logic signal, the signal is active low where the logically true state corresponds to a logic level zero. In the case of a positive logic signal, the signal is active high where the logically true state corresponds to a logic level one. Note that any of the signals described herein can be designed as either negative or positive logic signals. Therefore, in alternate embodiments, those signals described as positive logic signals may be implemented as negative logic signals, and those signals described as negative logic signals may be implemented as positive logic signals.

Those skilled in the art will recognize that the boundaries between logic blocks and circuit components are merely illustrative and that alternative embodiments may merge logic blocks or circuit elements or impose an alternate decomposition of functionality upon various logic blocks or circuit elements. However, it will be appreciated that some functionality may be shared between the various components. Thus, it is to be understood that the architectures depicted herein are merely exemplary, and that in fact many other architectures can be implemented which achieve the same functionality. For example, the current sources may be fixed or switched in some examples. In other examples, they may be replaced by resistors and switched resistors. In other examples, it is envisaged that some applications may only require a dynamic compensation, not an additional current boost, as provided by current boost 220 in FIG. 2. In other examples, it is envisaged that alternative transistor types and/or related technologies, voltages or currents may be used in contrast to those identified in the above description.

In some examples, it is also envisaged that the OVP loop and the watchdog loop are two independent features to address LDO performance transitioning outside of a desired range. As such, it is envisaged that a user may select to implement either one, or the other, or both, for example dependent upon the targeted application.

In some examples, an extreme simplification of the concepts herein described may be that the LDO is replaced by a non-regulated voltage reference. In such a case, the load is likely to be fixed, and only increase or decrease over a reasonable length of time, thus transitioning slowly back to the same average value. In that case, the watchdog loop may readjust the reference value employed by the dynamic compensation loop.

Any arrangement of components to achieve the same functionality is effectively 'associated' such that the desired functionality is achieved. Hence, any two components herein combined to achieve a particular functionality can be seen as 'associated with' each other such that the desired functionality is achieved, irrespective of architectures or intermediary components.

Likewise, any two components so associated can also be viewed as being 'operably connected', or 'operably coupled', to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms 'a' or 'an', as used herein, are defined as one or more than one. Also, the use of introductory phrases such as 'at least one' and 'one or more' in the claims should not be construed to imply that the introduction of another claim element by the indefinite articles 'a' or 'an' limits any particular claim containing such introduced claim element to inventions containing only one such element, even when the same claim includes the introductory phrases 'one or more' or 'at least one' and indefinite articles such as 'a' or 'an'. The same holds true for the use of definite articles. Unless stated otherwise, terms such as 'first' and 'second' are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

What is claimed is:

1. A low drop out (LDO) voltage regulator circuit comprises:

a high gain amplifier configured to receive a current biasing signal and a differential input voltage and configured to provide a differential output;

an output transistor having a drain electrode coupled to a voltage supply terminal, and a source electrode coupled to provide a regulated voltage supply signal;

an integration node coupled to a gate electrode of the output transistor;

a transistor mirror circuit coupled to the differential output of the high gain amplifier and the integration node;

a regulation adjustment circuit operably coupled to receive the regulated voltage supply signal and comprising a comparator configured to compare the regulated voltage supply signal with a threshold;

a compensation capacitor coupled between an output of the comparator and the integration node, wherein the comparator is configured to:

supply a dynamic current boost to the current biasing signal, in response to a voltage of the regulated voltage supply signal dropping below a first threshold, wherein the dynamic current boost is provided by the comparator generating a boost current and providing the boost current, via the compensation capacitor, to the integration node.

2. The LDO voltage regulator circuit of claim 1, wherein the regulation adjustment circuit comprises a watchdog loop circuit operably coupled to the output of the high gain amplifier and wherein the comparator comprises a watchdog comparator configured to compare the voltage of the regulated voltage supply signal with a watchdog threshold reference voltage and in response to the voltage of the regulated voltage supply signal dropping below the watchdog threshold reference voltage an output of the watchdog comparator supplies the dynamic current boost to the current biasing signal.

3. The LDO voltage regulator circuit of claim 2, wherein the watchdog comparator is configured to supply the dynamic current boost to the current biasing signal until the voltage of the regulated voltage supply signal has transitioned above the watchdog threshold reference voltage.

4. The LDO voltage regulator circuit of claim 2, further comprising at least one programmable controller configured to generate the watchdog threshold reference voltage and apply said watchdog threshold reference voltage to the watchdog comparator.

5. The LDO voltage regulator circuit of claim 1, wherein the regulation adjustment circuit further comprises an over voltage protection (OVP) loop circuit operably coupled to the output of the high gain amplifier and wherein the comparator comprises an OVP comparator configured to compare the voltage of the regulated voltage supply signal with an OVP threshold reference voltage and in response to the voltage of the regulated voltage supply signal exceeding the OVP threshold reference voltage the output of the OVP comparator activates a dynamic current pull down circuit to reduce an over voltage output of the LDO voltage regulator circuit.

6. The LDO voltage regulator circuit of claim 5, wherein the OVP comparator activates the dynamic current pull down circuit by providing an additional bleeding current on an LDO output stage.

7. The LDO voltage regulator circuit of claim 1, wherein the high gain amplifier is an Operational Transconductance Amplifier (OTA).

8. The LDO voltage regulator circuit of claim 1, wherein the dynamic current boost is independent from an OTA biasing current.

9. The LDO voltage regulator circuit of claim 8, wherein the compensation capacitor provides a capacitive coupling between an output of the comparator and an integration node, thereby increasing the regulated output voltage and reducing the LDO voltage regulator circuit sensitivity to a load current increase.

10. The LDO voltage regulator circuit of claim 1, wherein the transistor mirror circuit is configured to convert the differential output to a single ended output voltage on the integration node.

11. The LDO voltage regulator circuit of claim 1, further comprising a pair of cascoded current sources, wherein a first cascoded current source of the pair of cascoded current sources includes a first current source coupled to a source electrode of a first transistor and a second cascoded current source of the pair of cascoded current sources includes a second current source coupled to a source electrode of a second transistor, wherein a first output of the differential output is coupled to a first circuit node between the first current source and the first transistor and a second output of the differential output is coupled to a second circuit node between the second current source and the second transistor.

12. The LDO voltage regulator circuit of claim 11, wherein the integration node is at the drain electrode of the second transistor.

13. The LDO voltage regulator circuit of claim 1, wherein the comparator generates the boost current while the voltage of the regulated voltage supply signal is below the threshold.

14. A method of regulating a voltage supply signal in a low drop out (LDO) voltage regulator circuit, the method comprising:

receiving the voltage supply signal;

amplifying the voltage supply signal using a high gain amplifier configured to receive a current biasing signal and outputting a differential output from the high gain amplifier;

using a current mirror to convert the differential output to a single ended output voltage on an integration node at a gate electrode of an output transistor;

outputting a regulated voltage supply signal at an output node which is coupled to a drain electrode of the output transistor;

comparing a voltage of the regulated voltage supply signal with a threshold by a comparator;

detecting whether the voltage of the regulated voltage supply signal drops below the threshold and in response thereto supplying a dynamic current boost to the current biasing signal, wherein the dynamic current boost is provided by the comparator generating a boost current and providing the boost current to the integration node via a compensation capacitor coupled between the integration node and the output of the comparator.

15. The method of claim 14 wherein comparing the voltage of the regulated voltage supply signal with a threshold comprises comparing the voltage of the regulated voltage supply signal with a watchdog reference threshold voltage by a watchdog comparator; detecting whether the voltage of the regulated voltage supply signal drops below the watchdog threshold reference voltage; and in response thereto supplying the dynamic current boost to the LDO current biasing signal using an output of the watchdog comparator.

16. The method of claim 14, further comprising detecting whether the voltage of the regulated voltage supply signal exceeds a second threshold and in response thereto activating a dynamic current pull down circuit to reduce an over voltage output of the LDO voltage regulator circuit, and wherein comparing the voltage of the regulated voltage supply signal with a threshold comprises comparing the output regulated voltage supply signal with an over voltage protection (OVP) threshold reference voltage by an OVP comparator; detecting whether the voltage of the regulated voltage supply signal exceeds the OVP threshold reference voltage; and in response thereto activating the dynamic current pull down circuit to reduce an over voltage output of the LDO voltage regulator circuit.

17. A low drop out (LDO) voltage regulator circuit comprises:

a high gain amplifier configured to receive a current biasing signal and a differential input voltage and configured to provide a differential output;

cascoded current sources having a first cascoded current source which includes a first current source coupled to a source electrode of a first transistor and a second cascoded current source which includes a second current source coupled to a source electrode of a second transistor, wherein a first output of the differential output is coupled to a first circuit node between the first current source and the first transistor and a second output of the differential output is coupled to a second circuit node between the second current source and the second transistor;

a transistor mirror circuit coupled to the cascoded current sources;

an integration circuit node at a drain electrode of the second transistor;

a comparator having a first input coupled to the regulated voltage supply signal and a second input coupled to receive a threshold; and a compensation capacitor coupled between an output of the comparator and the second circuit node wherein the comparator is configured to generate a boost current which is provided, via the compensation capacitor, to the integration node while the voltage of the regulated voltage signal is below the first threshold.

18. The LDO voltage regulator circuit of claim 17, wherein the transistor mirror circuit is configured to convert the differential output to a single ended output voltage on the integration node.

19. The LDO voltage regulator circuit of claim 17, wherein the comparator is characterized as an open loop comparator.

20. The LDO voltage regulator circuit of claim 17, further comprising a decoupling capacitor coupled to the integration node.

* * * * *